US011386786B2

(12) United States Patent
Reiher

(10) Patent No.: US 11,386,786 B2
(45) Date of Patent: Jul. 12, 2022

(54) METHOD FOR CLASSIFYING A RELEVANCE OF AN OBJECT

(71) Applicant: Robert Bosch GmbH, Stuttgart (DE)

(72) Inventor: Marcus Steffen Reiher, Renningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/252,495

(22) PCT Filed: Jun. 24, 2019

(86) PCT No.: PCT/EP2019/066586
§ 371 (c)(1),
(2) Date: Dec. 15, 2020

(87) PCT Pub. No.: WO2020/011516
PCT Pub. Date: Jan. 16, 2020

(65) Prior Publication Data

US 2021/0192953 A1 Jun. 24, 2021

(30) Foreign Application Priority Data

Jul. 7, 2018 (DE) ..... 102018211240.1

(51) Int. Cl.
*G08G 1/16* (2006.01)

(52) U.S. Cl.
CPC ..... *G08G 1/165* (2013.01)

(58) Field of Classification Search
None
See application file for complete search history.

(56) References Cited

U.S. PATENT DOCUMENTS 5,948,035 A * 9/1999 Tomita ..... B60T 8/172 701/79
6,842,684 B1 * 1/2005 Kade ..... B60T 7/22 701/79

(Continued)

FOREIGN PATENT DOCUMENTS

DE 102008036009 A1 10/2009
DE 102008046488 A1 3/2010

OTHER PUBLICATIONS

International Search Report for PCT/EP2019/066586, dated Oct. 8, 2019.

*Primary Examiner* — Muhammad Adnan
(74) *Attorney, Agent, or Firm* — Norton Rose Fulbright US LLP; Gerard A. Messina

(57) ABSTRACT

A method for classifying a relevance of an object situated in a surrounding environment of a motor vehicle that includes an environmental sensor, with regard to a collision with the motor vehicle. The method includes: receiving measurement signals representing a radial distance, measured by the environmental sensor, of the object relative to the environmental sensor, a radial relative velocity, measured by the environmental sensor, of the object relative to the environmental sensor, and a measured own velocity of the motor vehicle; receiving dimension signals representing the dimensions of the motor vehicle; calculating whether the motor vehicle can collide with the object based on the received measurement signals and on the received dimension signals; outputting a result signal that represents a result of the calculation of whether the motor vehicle can collide with the object to classify the relevance of the object with regard to a collision with the motor vehicle.

8 Claims, 1 Drawing Sheet

(56) References Cited

U.S. PATENT DOCUMENTS 9,280,899 B2 * 3/2016 Biess ..... G08G 1/166
10,026,320 B2 * 7/2018 Ryu ..... G08G 1/166
10,468,062 B1 * 11/2019 Levinson ..... G01S 13/867
11,127,304 B2 * 9/2021 Fröhlich ..... G01S 19/53
2002/0154032 A1 * 10/2002 Hilliard ..... G08G 1/042 340/941
2009/0015462 A1 * 1/2009 Nakanishi ..... G08G 1/167 342/107
2009/0192710 A1 * 7/2009 Eidehall ..... B60W 50/0097 701/300
2011/0160950 A1 * 6/2011 Naderhirn ..... G08G 5/045 701/28
2014/0184400 A1 * 7/2014 Yang ..... B60Q 1/525 340/435
2014/0195132 A1 7/2014 Cund et al.
2016/0116593 A1 * 4/2016 Kim ..... G01S 17/931 356/5.01
2016/0291149 A1 * 10/2016 Zeng ..... G01S 13/931
2017/0242443 A1 * 8/2017 Schuh ..... G01S 13/931
2017/0284824 A1 * 10/2017 Korzunov ..... G01C 21/3629
2018/0068206 A1 * 3/2018 Pollach ..... G06K 9/6289
2018/0373980 A1 * 12/2018 Huval ..... G06K 9/6254
2019/0179317 A1 * 6/2019 Englard ..... G05D 1/0094
2019/0243371 A1 * 8/2019 Nister ..... G05D 1/0891
2019/0316914 A1 * 10/2019 Shin ..... G01C 21/30
2019/0369228 A1 * 12/2019 Stachnik ..... G01S 13/931
2020/0057090 A1 * 2/2020 Stachnik ..... G06F 17/16
2020/0182985 A1 * 6/2020 Wu ..... G01S 17/14
2020/0242942 A1 * 7/2020 Gilbert ..... G08G 1/052
2020/0262422 A1 * 8/2020 Kamiya ..... B60W 30/18159
2020/0327338 A1 * 10/2020 Philion ..... G05D 1/0088
2021/0192953 A1 * 6/2021 Reiher ..... G08G 1/165
2021/0261159 A1 * 8/2021 Pazhayampallil .. B60W 30/181
2021/0339741 A1 * 11/2021 Rezvan Behbahani ..... B60W 30/0956
2021/0380099 A1 * 12/2021 Lee ..... B60W 30/18163

* cited by examiner

METHOD FOR CLASSIFYING A RELEVANCE OF AN OBJECT

FIELD

The present invention relates to a method for classifying a relevance of an object. The present invention further relates to a device that is set up to carry out all steps of the method for classifying a relevance of an object. In addition, the present invention relates to a computer program. The present invention further relates to a machine-readable storage medium.

BACKGROUND INFORMATION

The classification of the relevance of the stationary environment surrounding a vehicle presents a challenge for particular types of environmental sensors (e.g., radar) of the related art. The goal of the stated classification is to distinguish functionally relevant elements of the stationary environment surrounding the vehicle (e.g., parked vehicles), in response to which a regulation (e.g., braking) should take place, from non-relevant objects such as overhead sign gantry structures (that can be driven under) or objects on the ground (that can be driven over), in response to which no regulation is to take place.

In the classification under consideration, the challenge is in particular to adequately suppress false positive relevance reports while at the same time maintaining the same high level of performance with regard to the positive reporting of relevant objects. Normally, for this purpose complex classification approaches in a high-dimensional feature space are used, in which the individual features often do not directly evaluate the relevance property of an object, but rather do this indirectly, using derived quantities. These derived quantities presuppose complex assumptions concerning the nature or the behavior of the respective objects, which limits the robustness of the classifier based thereon.

SUMMARY

An object of the present invention is to provide a design for the efficient classification of a relevance of an object that is situated in a surrounding environment of a motor vehicle that includes an environmental sensor with regard to a collision with the motor vehicle.

This object may be achieved in accordance with example embodiments of the present invention. Advantageous embodiments of the present invention are described herein.

According to a first aspect of the present invention, a method is provided for classifying a relevance of an object situated in a surrounding environment of a motor vehicle that has an environmental sensor with regard to a collision with the motor vehicle. In accordance with an example embodiment of the present invention, the method includes the following steps:

receiving measurement signals that represent a radial distance $d_r$, measured by the environmental sensor, of the object relative to the environmental sensor, a radial relative velocity $v_r$, measured by the environmental sensor, of the object relative to the environmental sensor, and a measured own velocity $v_{ego}$ of the motor vehicle;

receiving dimension signals that represent the dimensions of the motor vehicle;

calculating whether the motor vehicle can collide with the object, based on the received measurement signals and based on the received dimension signals;

outputting a result signal that represents a result of the calculation of whether the motor vehicle can collide with the object in order to classify the relevance of the object with regard to a collision with the motor vehicle.

According to a second aspect of the present invention, a device is provided that is set up to carry out all steps of the method according to the first aspect of the present invention.

According to a third aspect of the present invention, a computer program is provided that includes commands that, when the computer program is executed by a computer, cause this computer to carry out a method according to the first aspect of the present invention.

According to a fourth aspect of the present invention, a machine-readable storage medium is provided on which the computer program according to the third aspect of the present invention is stored.

The present invention is based on the recognition that the above object can be achieved by using, for the classification of the relevance of the object, dimensions of the motor vehicle and measurement values that can be measured easily, efficiently, and accurately by a standard environmental sensor. These measurement values are the radial distance of the object relative to the environmental sensor and the radial relative velocity of the object relative to the environmental sensor, i.e., relative to the motor vehicle if the environmental sensor is part of the motor vehicle or is situated on it.

In addition, the classification of a relevance of an object is carried out using the measured own velocity of the motor vehicle; such an own velocity can also be measured easily, efficiently, and accurately.

In this way, in particular the technical advantage is brought about that the relevance of the object can be classified using values that are easy to obtain, in the present case the measurement signals and the dimension signals (the dimensions of the motor vehicle are known quantities).

Compared to the related art, therefore, no complex classification approaches in a high-dimensional feature space are required, so that complex assumptions about the nature or the behavior of the object do not have to be made.

Correspondingly, the design according to the present invention is advantageously particularly robust compared to the related named above.

In addition, the design according to the present invention has the technical advantage that the radial distance and the radial relative velocity can be measured using an environmental sensor that has a simple design and can be produced at low cost.

In sum, a technical advantage may be brought about that a design is provided for the efficient classification of a relevance of an object that is situated in a surrounding environment of a motor vehicle that includes an environmental sensor with regard to a collision with the motor vehicle.

In a specific embodiment of the present invention, the environmental sensor is set up to measure a radial distance of the object and its radial relative velocity relative to the environmental sensor, i.e., to the motor vehicle.

According to a specific embodiment of the present invention, the environmental sensor is designed for a runtime measurement. That is, the environmental sensor is designed to carry out a runtime measurement. In this case, the environmental sensor can also be designated a runtime measurement sensor.

The environmental sensor is for example a radar sensor, a lidar sensor, or an ultrasonic sensor.

In a specific embodiment of the present invention, the environmental sensor is a video sensor.

According to a specific embodiment of the present invention, it is provided that the calculation of whether the motor vehicle can collide with the object includes a calculation of a location uncertainty value based on the received measurement signals, the location uncertainty value indicating an item of location information relating to possible locations of the object, a calculation of a threshold value based on the received dimension signals, and a comparison of the location uncertainty value with the threshold value, so that the result is a function of the comparison.

As a result, for example the technical advantage is brought about that the calculation of whether the motor vehicle can collide with the object can be carried out efficiently. For example, here the comparison enables a simple yes/no statement as to whether the motor vehicle can collide with the object.

In a specific embodiment of the present invention, it is provided that the calculation whether the motor vehicle can collide with the object is carried out based on at least one of the following assumptions: the object is a stationary object, a time derivative of a yaw rate ψ of the motor vehicle is zero, a time derivative of a pitch rate φ of the motor vehicle is zero. The assumption that the object is a stationary object is uncritical in particular when the measured radial velocity at the measured location of the object agrees sufficiently accurately with the own velocity of the motor vehicle. Here, "sufficiently accurately" means, for example, within an error tolerance of less than, or less than or equal to, 10%, for example less than, or less than or equal to, 5%, for example less than, or less than or equal to, 1%, relative to the own velocity of the motor vehicle. According to a specific embodiment, the time derivatives of the yaw rate and pitch rate of the motor vehicle are ascertained, for example with adequate accuracy, by one or more electronic stability programs of the motor vehicle. The correctness of the assumptions can thus also in particular be easily checked.

In this way, for example a technical advantage may be brought about that the calculation of whether the motor vehicle can collide with the object can be carried out efficiently. In particular, in this way a technical advantage may be brought about that, using at least one of these assumptions, the calculation can be carried out using analytically solvable equations.

According to a specific embodiment of the present invention, it is provided that a position signal is received, the position signal representing a position of the environmental sensor on the motor vehicle, the calculation of whether the motor vehicle can collide with the object being carried out based on the received position signal.

In this way, for example the technical advantage is brought about that the calculation of whether the motor vehicle can collide with the object can be carried out efficiently. In particular, by taking into account the position of the environmental sensor on the motor vehicle, a more accurate statement is enabled as to whether the motor vehicle can collide with the object.

In a specific embodiment of the present invention, it is provided that the calculation of whether the motor vehicle can collide with the object is carried out based on all the assumptions, the dimensions of the motor vehicle including a width B and a height H, the position of the environmental sensor being specified by a height h above the ground and a distance b eccentric to a longitudinal axis of the motor vehicle, the location uncertainty value being calculated according to $$d_r^2\left(1-\left(\frac{v_r}{v_{ego}}\right)^2\right)t,$$

the threshold value being calculated according to $$\max(h^2,\ (H-h)^2)+\max\left(\left(\frac{B}{2}+b\right)^2,\ \left(\frac{B}{2}-b\right)^2\right),$$

such that, if the location uncertainty value is less than, or less than or equal to, the threshold value, the result is calculated that the motor vehicle cannot collide with the object, and if the location uncertainty value is greater than the threshold value, the result is calculated that the motor vehicle can collide with the object.

In this way, for example the technical advantage may be brought about that the calculation of whether the motor vehicle can collide with the object can be carried out efficiently. According to this specific embodiment, possible locations of the object lie on a circle having a radius that is equal to the root of the uncertainty value, the circle having a center that is situated at the radial distance from the location of installation of the environmental sensor.

In another specific embodiment of the present invention, it is provided that the measurement signals represent a transverse offset dy of the object, measured by the environmental sensor, the calculation of whether the motor vehicle can collide with the object being carried out based on all the assumptions, the dimensions of the motor vehicle including a height H, the position of the environmental sensor being specified by a height h above the ground, the location uncertainty value being calculated according to $$d_r^2\left(1-\left(\frac{v_r}{v_{ego}}\right)^2\right)-d_y^2,$$

the threshold value being calculated according to $\max(h^2, (H-h)^2)$, such that, if the location uncertainty value is less than, or less than or equal to, the threshold value the result is calculated that the motor vehicle cannot collide with the object, and if the location uncertainty value is greater than the threshold value the result is calculated that the motor vehicle can collide with the object.

In this way, for example the technical advantage may be brought about that the calculation of whether the motor vehicle can collide with the object can be carried out efficiently. According to this specific embodiment of the present invention, the circle named in connection with the preceding specific embodiment is reduced to two possible locations of the object. Thus, a finer estimation of the relevance of the object can advantageously take place.

Here, in particular it is implicitly assumed that the relevance was already ascertained via the lateral position, and the equation is then applied only if an object is already relevant due to the lateral position, and it remains only to make a decision about the unknown elevation.

In a specific embodiment of the present invention, it is provided that the measurement signals represent a measured elevation offset having an error value, the measured elevation offset being corrected based on the measured elevation offset and the location uncertainty value.

In this way, for example the technical advantage is brought about that an estimation of the elevation offset can be efficiently and significantly improved.

According to a specific embodiment of the present invention, the environmental sensor is set up in order to map a surrounding environment or surroundings of the motor vehicle.

In particular, the environmental sensor is able to measure, in addition to the (radial) distance of the object, its radial relative velocity as well. Therefore, for example the following relation holds between the measurement variables (radial distance and radial relative velocity), the following calculations being carried out relative to a three-dimensional Cartesian space. Thus, an x, y, z coordinate system is defined as follows: the x axis of the coordinate system runs parallel to the longitudinal axis of the motor vehicle, the y axis of the coordinate system runs transverse to the motor vehicle, the z axis of the coordinate system runs perpendicular to the x and y axes, and the center of the coordinate system is situated in the center of the environmental sensor.

The radial relative velocity $v_r$ of the object accordingly corresponds to the scalar product of the relative position p of the object in Cartesian coordinates (dx, dy, dz; coordinate origin at the location of the sensor) and the relative velocity $v_r$ of this object in the same coordinate system (vx, vy, vz), normed to the Cartesian (radial) distance $d_r$ of the object. In the following, dx designates the longitudinal offset of the object, dy designates the transverse offset of the object, and dz designates the elevation offset of the object.

In the following, it is assumed that the object is a stationary object. This assumption is justified for example for object velocities that are negligibly small relative to the velocity of the motor vehicle.

According to a specific embodiment of the present invention, the object is a stationary object.

Thus, if it is assumed that the object is a stationary object (whose identification/filtering is possible in the currently related art using simple methods), then the components of the relative velocity (vx, vy, vz) are specified or calculated completely via the movement of the motor vehicle, the following approximations or assumptions being for example used, and it being noted that the approximation is used only in order to simplify the representation of the following steps:

The relative velocity $v_r$ in the longitudinal direction (vx) accordingly corresponds to the negative own velocity $v_{ego}$ of the motor vehicle, and the two other velocity components (vy, vz) result approximately from the negative rates of rotation of the motor vehicle about its vertical axis (yaw rate, ψ) and about its transverse axis (pitch rate, ω), which can be converted from an angular velocity into a Cartesian velocity by multiplication by the radial distance $d_r$. Using a simple transformation for the radial distance ($d_r$) and the longitudinal distance (dx), the following approximation holds for the radial relative velocity:

$$v_r = \frac{1}{|p|} v^t p =: \frac{1}{d_r}(d_x v_x + d_y v_y + d_z v_z)$$

$$v_x \approx -v_{ego}$$

$$v_y \approx -d_r \frac{\partial \varphi}{\partial t}$$

$$v_z \approx -d_r \frac{\partial \omega}{\partial t}$$

-continued $$d_x = \sqrt{d_r^2 - d_y^2 - d_z^2} = > \frac{d_x}{d_r} = \sqrt{1 - \frac{d_y^2 + d_z^2}{d_r^2}}$$

$$-v_r \approx \sqrt{1 - \frac{d_y^2 + d_z^2}{d_r^2}}\, v_{ego} + d_y \frac{\partial \varphi}{\partial t} + d_z \frac{\partial \omega}{\partial t}$$

For the further simplification of the representation, in the following only situations are considered in which the motor vehicle is moving with an approximately constant velocity and without significant rates of rotation (this state can be directly determined for example on the basis of signals of an ESP sensor of the motor vehicle). That is, it is assumed that a time derivative of the yaw rate of the motor vehicle, a time derivative of the pitch rate of the motor vehicle, and a time derivative of the own velocity of the motor vehicle are zero. In particular, the following holds:

$$\frac{\partial \varphi}{\partial t} = \frac{\partial \omega}{\partial t} = 0,$$

and there thus follows, finally, the simple approximation:

$$D^2 := d_y^2 + d_2^2 \approx d_r^2\left(1 - \left(\frac{v_r}{v_{ego}}\right)^2\right)$$

Accordingly, a mixed form D of the transverse offset dy and the elevation offset dz of the measured object (in each case relative to the environmental sensor position) can be inferred solely from the measurement of the radial distance $d_r$, the radial relative velocity $v_r$, and the own velocity of the vehicle $v_{ego}$. Here $D^2$ designates the location uncertainty value described above and in the following.

On the basis of such an individual measurement, the possible combinations of dy and dz in the Cartesian space thus describe a circle (also referred to as the uncertainty circle in the following) having radius D and distance $d_r$ from the location of installation of the environmental sensor. The required measurement variables can for example be ascertained using low-cost radar sensors having minimal constructive size, because no complex antenna structures are required to determine the angle of incidence of the reflected signals.

In addition, the value of the relative velocity is independent of a possible rotation or maladjustment of the environmental sensor, which further increases the robustness.

On the basis of the value of $D^2$, with the above illustration a very simple evaluation of the relevance of the object can take place in space.

A necessary condition for the collision with the object at a future time is that both its transverse offset dy and its elevation offset dz are in a region that corresponds to the dimensions of the motor vehicle (having width B, height H).

Under the assumption that the environmental sensor is mounted on the motor vehicle by the distance b from the center and at a height h above the ground, the home vehicle can collide only with an object whose value for $D^2$ is less than, or less than or equal to, the following threshold value:

$$\max(h^2, (H-h)^2) + \max\left(\left(\frac{B}{2} + b\right)^2, \left(\frac{B}{2} - b\right)^2\right)$$

If, conversely, the value $D^2$ is greater than the above threshold value, then the motor vehicle cannot collide with the stationary object under consideration, for which reason this object does not have to be taken into consideration for a regulation of a transverse and/or longitudinal guidance of the motor vehicle.

Thus, already on the level of the environmental sensor measurement variables a robust pre-selection of the relevant objects is enabled, which for example reduces the computing time requirement in subsequent data processing layers of the system and enables higher update rates or lower-cost computing units.

If the environmental sensor can itself also determine the transverse offset dy of an object directly, in addition to the radial distance $d_r$ and the radial relative velocity $v_r$, which is almost always the case in modern radar sensors, then the above approximation can be refined to an estimate of the (absolute) elevation offset dz of the corresponding object. The uncertainty circle in the space from the above example now degrades to two possible point-type locations of the object.

The location uncertainty value is calculated as follows:

$$d_z^2 \approx d_r^2\left(1-\left(\frac{v_r}{v_{ego}}\right)^2\right)-d_y^2$$

The threshold value is calculated as follows:

$$\max(h^2,(H-h)^2)$$

If the location uncertainty value is less than, or less than or equal to, the threshold value, then the result is calculated that the motor vehicle cannot collide with the object. If the location uncertainty value is greater than the threshold value, then the result is calculated that the motor vehicle can collide with the object.

Even if the environmental sensor, based on its antenna structure, is not capable of measuring the elevation of an object, with the method described here a direct estimation of the absolute elevation offset can thus take place at least for a stationary object. On the basis of this estimation, analogous to the procedure described above, a finer estimation can be made of the relevance of the stationary object under consideration.

Finally, if the antenna structures of the environmental sensor also permit a measurement of the elevation offset, then using the described method the estimation of this elevation can still be significantly improved, because the variables required for this are frequently available with a higher degree of accuracy than is permitted by the direct measurement of the elevation via the antenna structure of the radar sensor.

According to a specific embodiment of the present invention, it is provided that the method according to the first aspect of the present invention is carried out by the device according to the second aspect of the present invention.

Method features result immediately from corresponding device features, and vice versa.

That is, in particular, technical functionalities with regard to the device result analogously from corresponding technical functionalities of the method, and vice versa.

Below, the present invention is explained in more detail on the basis of preferred exemplary embodiments.

DETAILED DESCRIPTION OF EXAMPLE EMBODIMENTS

Figure 1:
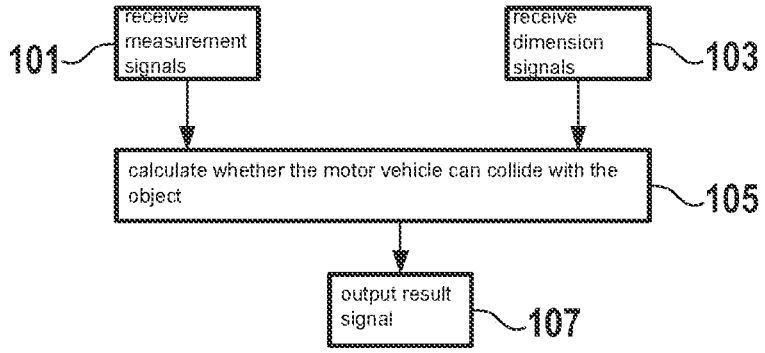
FIG. 1 shows a flow diagram of a method for classifying a relevance of an object, in accordance with an example embodiment of the present invention.

FIG. 1 shows a flow diagram of a method for classifying a relevance of an object that is situated in a surrounding environment of a motor vehicle that includes an environmental sensor with regard to a collision with the motor vehicle, including the following steps:

receiving 101 measurement signals that represent a radial distance $d_r$, measured by the environmental sensor, of the object relative to the environmental sensor, a radial relative velocity $v_r$ of the object, measured by the environmental sensor, relative to the environmental sensor, and a measured own property $v_{ego}$ of the motor vehicle;

receiving 103 dimension signals that represent the dimensions of the motor vehicle;

calculating 105 whether the motor vehicle can collide with the object, based on the received measurement signals and based on the received dimension signals;

outputting 107 a result signal that represents a result of the calculation of whether the motor vehicle can collide with the object, in order to classify the relevance of the object with regard to a collision with the motor vehicle.

Figure 2:
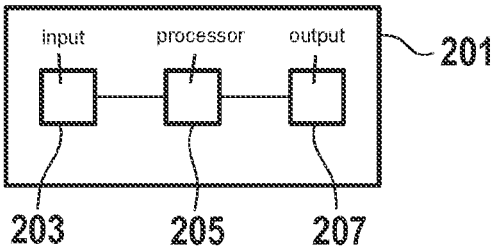
FIG. 2 shows a device that is set up to carry out a method for classifying a relevance of an object, in accordance with an example embodiment of the present invention.

FIG. 2 shows a device 201 that is set up to carry out all steps of a method for classifying a relevance of an object.

For example, device 201 is designed to carry out the method shown in FIG. 1.

Device 201 includes an input 203 for receiving measurement signals that represent a radial distance $d_r$, measured by the environmental sensor, of the object relative to the environmental sensor, a radial relative velocity $v_r$ of the object, measured by the environmental sensor, relative to the environmental sensor, and a measured own property $v_{ego}$ of the motor vehicle, and for receiving dimension signals that represent dimensions of the motor vehicle.

Device 201 includes a processor 205 for calculating whether the motor vehicle can collide with the object, based on the received measurement signals and based on the received dimension signals.

Device 201 further includes an output 207 for outputting a result signal that represents a result of the calculation of whether the motor vehicle can collide with the object, in order to classify the relevance of the object with regard to a collision with the motor vehicle.

According to a specific embodiment, a plurality of processors are provided for calculating whether the motor vehicle can collide with the object.

Figure 3:
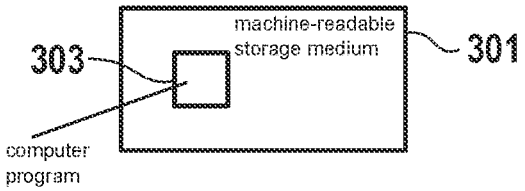
FIG. 3 shows a machine-readable storage medium, in accordance with an example embodiment of the present invention.

FIG. 3 shows a machine-readable storage medium 303 on which a computer program 303 is stored, computer program 303 including commands that, when the computer program is executed by a computer, for example by device 201 of FIG. 2, cause this computer to carry out all steps of a method for classifying a relevance of an object, for example all steps of the method shown in FIG. 1.

Figure 4:
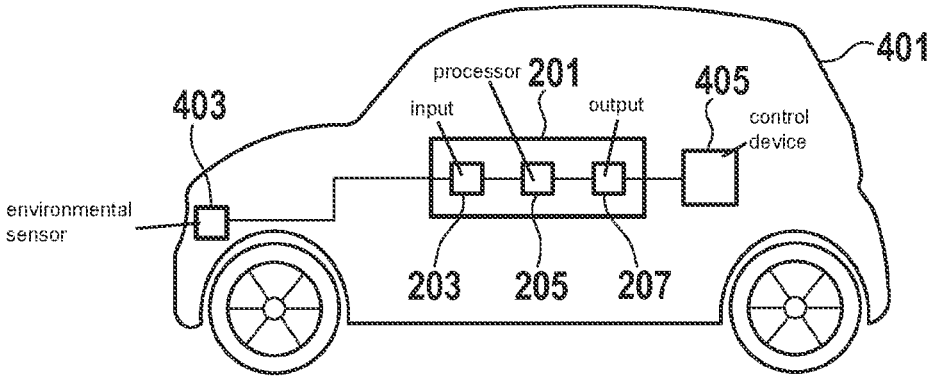
FIG. 4 shows a motor vehicle, in accordance with an example embodiment of the present invention.

FIG. 4 shows a motor vehicle 401.

Motor vehicle 401 includes an environmental sensor 403. Environmental sensor 403 is for example a radar sensor or a lidar sensor.

Motor vehicle 401 further includes device 201 according to FIG. 2.

Environmental sensor 403 acquires for example a surrounding environment of the motor vehicle. When an object is detected in the acquired surrounding environment, environmental sensor 403 can measure a radial distance of the object to environmental sensor 403, as well as a radial relative velocity of the object relative to the environmental sensor, i.e., to motor vehicle 401, if environmental sensor 403 is situated on motor vehicle 401.

Measurement signals corresponding to this measurement are sent to input 203 of device 201. Input 203 receives these measurement signals and receives further measurement signals that represent a measured own velocity of motor vehicle 401. These measurement signals and the further measurement signals are thus measurement signals that are received by processor 205 and that represent the radial distance $d_r$, measured by environmental sensor 403, of the object relative to environmental sensor 403, a radial relative velocity $v_r$, measured by environmental sensor 403, of the object relative to environmental sensor 403, and a measured own velocity $v_{ego}$ of motor vehicle 401.

Processor 205 calculates, as described above and/or in the following, whether the motor vehicle can collide with the object.

Processor 205 produces a result signal, resulting from the calculation, that is outputted via output 207.

For example, the result signal is outputted to a control device 405 of motor vehicle 401.

According to a specific embodiment, control device 405 is designed to control, based on the outputted result signal, a transverse and/or longitudinal guiding of motor vehicle 401.

In sum, the present invention provides for an efficient classification of a relevance of an object that is situated in a surrounding environment of a motor vehicle that includes an environmental sensor with regard to a collision with the motor vehicle. The design according to the present invention is based, inter alia, not on a temporal filtering of measured variables or hypotheses for the formation of objects, but rather is based in particular immediately on basis measured variables of an environmental sensor, which guarantees a high degree of general validity with regard to applicability and robustness. The basis measurement variables that are used, i.e., the measured radial distance and the measured radial relative velocity, can advantageously be provided by an environmental sensor that can be realized very economically.

What is claimed is:

1. A method for a motor vehicle that includes an environmental sensor, the method comprising:

receiving measurement signals that represent:

a radial distance, measured by the environmental sensor, of an object, that is situated in a surrounding environment of the motor vehicle, relative to the environmental sensor;

a radial relative velocity, measured by the environmental sensor, of the object relative to the environmental sensor; and a measured own velocity of the motor vehicle;

calculating, based on the received measurement signals, a location uncertainty value that indicates an item of location information of possible locations of the object;

receiving dimension signals that represent dimensions of the motor vehicle;

calculating a threshold value based on the received dimension signals;

comparing the location uncertainty value with the threshold value;

as a function of the comparison, calculating whether the motor vehicle can collide with the object; and outputting a result signal that represents a result of the calculation of whether the motor vehicle can collide with the object.

2. The method as recited in claim 1, wherein the calculation of whether the motor vehicle can collide with the object is carried out based on at least one of the following assumptions: the object is a stationary object, a time derivative of a yaw rate of the motor vehicle is zero, a time derivative of a pitch rate of the motor vehicle is zero, a time derivative of the own velocity of the motor vehicle is zero.

3. The method as recited in claim 1, wherein a position signal is received, the position signal representing a position of the environmental sensor on the motor vehicle, and wherein the calculation of whether the motor vehicle can collide with the object is carried out based additionally on the received position signal.

4. The method as recited in claim 2, wherein:

the calculation of whether the motor vehicle can collide with the object being carried out based on all of the assumptions;

the dimensions of the motor vehicle include a width B and a height H;

the position of the environmental sensor is specified by a height h above ground and a distance b that is eccentric relative to a motor vehicle longitudinal axis;

the location uncertainty value is calculated according to $$d_r^2\left(1-\left(\frac{v_r}{v_{ego}}\right)^2\right);$$

the threshold value is calculated according to $$\max(h^2, (H-h)^2)+\max\left(\left(\frac{B}{2}+b\right)^2, \left(\frac{B}{2}-b\right)^2\right);$$

when the location uncertainty value is less than, or less than or equal to, the threshold value, the result is calculated to be that the motor vehicle cannot collide with the object;

when the location uncertainty value is greater than the threshold value, the result is calculated to be that the motor vehicle can collide with the object;

$d_r$ is the radial distance;

$v_r$ the radial relative velocity; and $v_{ego}$ is the measured own velocity of the motor vehicle.

5. The method as recited in claim 2, wherein:

the measurement signals represent a transverse offset dy, measured by the environmental sensor, of the object;

the calculation of whether the motor vehicle can collide with the object is carried out based on all of the assumptions;

the dimensions of the motor vehicle include a height H;

the position of the environmental sensor is specified by a height h above the ground;

the location uncertainty value is calculated according to $$d_r^2\left(1-\left(\frac{v_r}{v_{ego}}\right)^2\right)-d_y^2;$$

the threshold value is calculated according to $\max(h^2, (H-h)^2)$;

when the location uncertainty value is less than, or less than or equal to, the threshold value, the result is calculated to be that the motor vehicle cannot collide with the object;

if the location uncertainty value is greater than the threshold value, the result is calculated to be that the motor vehicle can collide with the object;

$d_r$ is the radial distance;

$v_r$ the radial relative velocity; and $v_{ego}$ is the measured own velocity of the motor vehicle.

6. The method as recited in claim 5, wherein the measurement signals represent a measured elevation offset having an error value, the measured elevation offset being corrected based on the measured elevation offset and the location uncertainty value.

7. A device for a motor vehicle that includes an environmental sensor, the device configured to:

receive measurement signals that represent:

a radial distance, measured by the environmental sensor, of an object, that is situated in a surrounding environment of the motor vehicle, relative to the environmental sensor;

a radial relative velocity, measured by the environmental sensor, of the object relative to the environmental sensor; and a measured own velocity of the motor vehicle;

calculate, based on the received measurement signals, a location uncertainty value that indicates an item of location information of possible locations of the object;

receive dimension signals that represent dimensions of the motor vehicle;

calculate a threshold value based on the received dimension signals;

compare the location uncertainty value with the threshold value;

as a function of the comparison, calculate whether the motor vehicle can collide with the object; and output a result signal that represents a result of the calculation of whether the motor vehicle can collide with the object.

8. A non-transitory machine-readable storage medium on which is stored a computer program for a motor vehicle that includes an environmental sensor, the computer program being executable by a computer and, when executed by the computer, causing the computer to perform the following steps:

receiving measurement signals that represent:

a radial distance, measured by the environmental sensor, of an object, that is situated in a surrounding environment of the motor vehicle, relative to the environmental sensor;

a radial relative velocity, measured by the environmental sensor, of the object relative to the environmental sensor; and a measured own velocity of the motor vehicle;

calculating, based on the received measurement signals, a location uncertainty value that indicates an item of location information of possible locations of the object;

receiving dimension signals that represent dimensions of the motor vehicle;

calculating a threshold value based on the received dimension signals;

comparing the location uncertainty value with the threshold value;

as a function of the comparison, calculating whether the motor vehicle can collide with the object; and outputting a result signal that represents a result of the calculation of whether the motor vehicle can collide with the object.

* * * * *